US005085453A

United States Patent [19]

Bildner

[11] Patent Number: 5,085,453

[45] Date of Patent: Feb. 4, 1992

[54] AUTOMATICALLY RELEASABLE SKI BINDING UNIT

[75] Inventor: Heinz H. Bildner, Seebruck, Fed. Rep. of Germany

[73] Assignee: Implementors Overseas Limited, Douglas, United Kingdom

[21] Appl. No.: 391,550

[22] PCT Filed: Nov. 25, 1988

[86] PCT No.: PCT/EP88/01076

§ 371 Date: Jul. 28, 1989

§ 102(e) Date: Jul. 28, 1989

[87] PCT Pub. No.: WO89/04701

PCT Pub. Date: Jun. 1, 1989

[30] Foreign Application Priority Data

Nov. 27, 1987 [DE] Fed. Rep. of Germany ..... 3740327

[51] Int. Cl.[5] ..... A63C 9/08

[52] U.S. Cl. ..... 280/612; 280/617; 280/633; 280/636

[58] Field of Search ..... 280/611, 612, 618, 616, 280/617, 631, 632, 633, 636, 625

[56] References Cited

U.S. PATENT DOCUMENTS

| | | | |
|---|---|---|---|
| 3,198,537 | 8/1965 | Silberman | 280/617 |
| 3,937,481 | 2/1976 | Koleda | 280/618 |
| 3,966,218 | 6/1976 | Beyl | 280/631 |
| 4,274,653 | 6/1981 | Himmetsberger et al. | 280/633 |
| 4,460,195 | 7/1984 | Bildner | 280/612 |
| 4,548,424 | 10/1985 | Spitaler | 280/612 |
| 4,572,540 | 2/1986 | Vinazzer et al. | 280/612 |

FOREIGN PATENT DOCUMENTS

| | | | |
|---|---|---|---|
| 2635409 | 2/1978 | Fed. Rep. of Germany | 280/633 |
| 3523058 | 1/1987 | Fed. Rep. of Germany | 280/616 |

*Primary Examiner*—David M. Mitchell

*Attorney, Agent, or Firm*—Wallenstein, Wagner & Hattis, Ltd.

[57] ABSTRACT

An automatically releasable ski binding unit has heel and toe binding units mounted to a common mounting platform, the toe unit being rotatable about an axis transverse to the longitudinal direction of the ski. A guide attachable to a ski is configured to slidingly captively accept the mounting platform for movement along the longitudinal direction of the ski. Rotation of the toe mounting unit from a normal to an upwardly extending position facilitates stepping into and out of the binding. A locking system provides for locking the mounting platform to the guide at a variety of chosen positions, the locking system being releasable by rotation of the toe binding unit towards the ski from the normal position adopted where a ski boot is inserted and the binding is locked. The heel release has a rear sole-engaging portion which is urged to the rear by the heel of an inserted ski boot during the locking operation. An electrically powered release including a solenoid is activated to release the heel binding unit when a rearward heel pressure significantly exceeding the static locking pressure is exceeded. A timer provides for delayed release requiring sustained excess rearward pressure for a given period of time. All electrical components are in the unpowered state at the static locking pressure and are actuated to a power consuming state when a threshold rearward heel pressure above the static locking pressure is exceeded.

15 Claims, 10 Drawing Sheets

3
4
1
70

15
7
13
16
13
7

23
4
22
16
2
22
5
22
1c 18
18
7
20
34
35
48
69
33
50
47
51
64
44
65
66
54
51
53
67
32
31
1
52
39
55
36
43
37
41
56
38

20
18
18
7
34
35
33
55
36
43
37
44
42
51
56
38
57
31
58
32
59
1
62
52

AUTOMATICALLY RELEASABLE SKI BINDING UNIT

The invention relates to an automatically releasable ski binding unit having interconnected front and heel parts, a mechanical boot retaining system, an electronic control system, and a release system for the ski boot.

Known ski bindings in actual application do not guarantee the reliable release of a ski boot under load. No distinction is being made between a jump and a fall and that means that the binding releases even in case of impacts of short duration. With known electronically controlled ski bindings, release becomes impossible when the power supply fails due to current consumption which is constantly high.

It is, therefore, the object of the invention to provide an automatically releasable ski binding which warrants reliable retention and release under all operating conditions and which can be exchanged, ready for operation, in simple manner among various skis.

The object is met, in accordance with the invention, with a ski binding unit of the kind defined initially, in that (a) the front part is tiltable about an axis which extends transversely of the longitudinal axis of the ski, (b) the heel part includes a housing, a backing member which is movable longitudinally with respect to the housing against spring load and which supports a sole holder, and a locking device adapted to couple the housing semirigidy to the backing member, (c) the sole holder, when loaded, is adapted to enter mechanically into functional connection by a signal transmitter with a signal receiver, the current supply being activated synchronously, an electromagnet being adapted to be activated after a predetermined time of action on the signal receiver, and the electromagnet, by being activated, operating a key arranged in the locking device, whereby longitudinal movement of the backing member with respect to the housing is permitted instantaneously.

The capability of the front part to tilt about a transversely disposed axis provides for strict separation between the functions of stepping into the binding unit and stepping out of it whenever desired by the skier, on the one hand, and release if there is a risk of injury, on the other hand:

The first function is associated exclusively with the front part; only this part is tilted downwardly by the skier from an entry position into a position of use when the skis are put on. Preferably that is done by simply pressing down the front part by means of the toe portion of the ski boot. Also for the desired stepping out of the binding unit, the skier usually actuates the front part only. That does not require the skier to turn around since he can easily actuate the front part by a ski pole while his body remains in the normal position.

On the other hand, release of the ski boot upon a fall is initiated by the heel part of the binding unit, and that happens after a certain time of action of a load which exceeds a limit value so that safe distinction is made between a shock which is not dangerous for the skier, for instance in taking a jump, and a fall which is taking a dangerous course.

The clear distinction between the normal functions of the front part, on the one hand, and the heel part, on the other hand, does not exclude that the heel part, too, is releasable voluntarily. That may be just as advantageous for purposes of demonstration or testing as in case the front binding cannot be reached easily by the skier because he got stuck in a snow cornice.

Embodiments of the invention are illustrated in the drawings and will be described in greater detail below. In the drawings.

Figures 2, 2A, 2B:
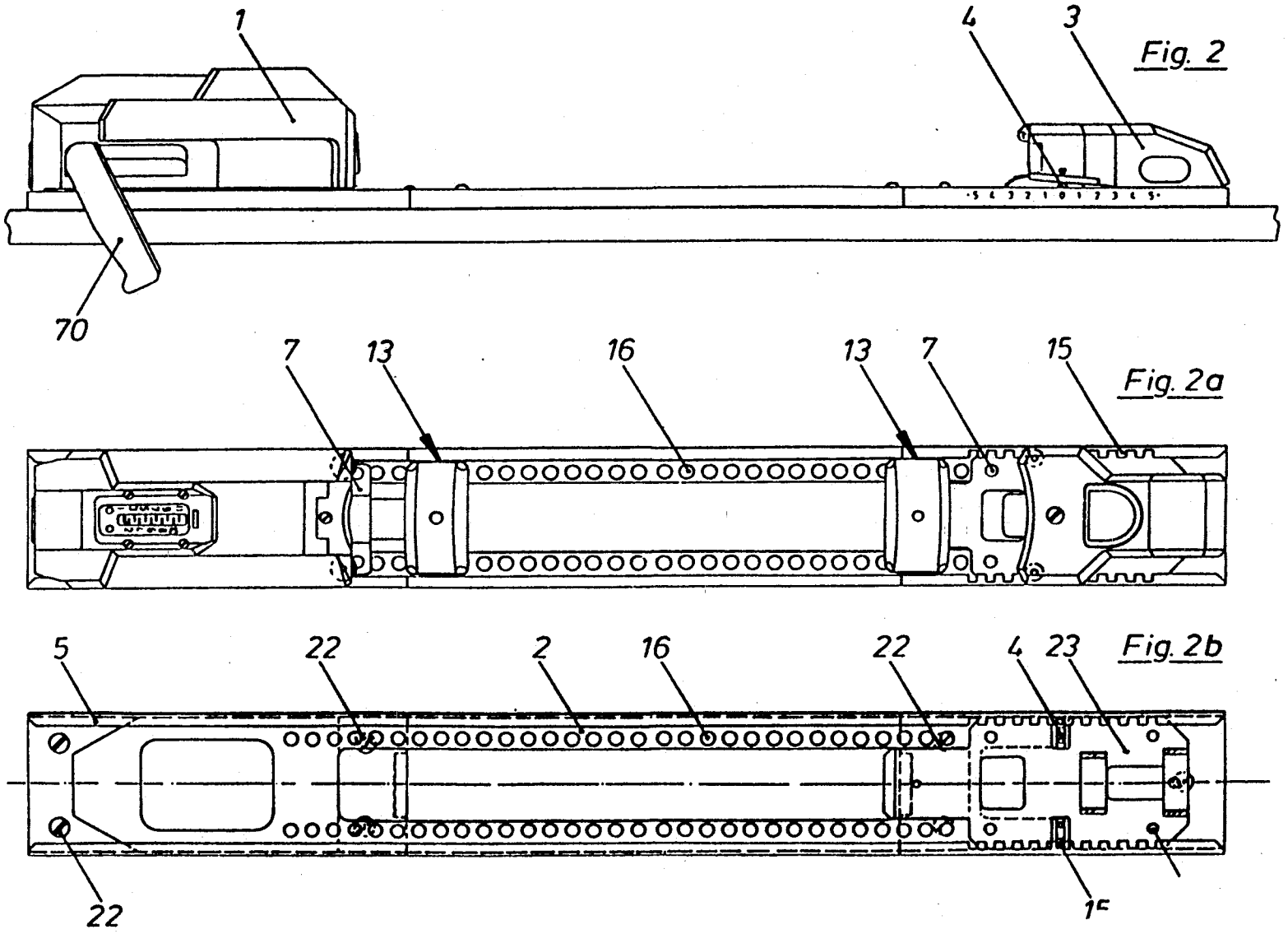
FIG. 2 is a side elevation of the ski binding.
Figure 3:
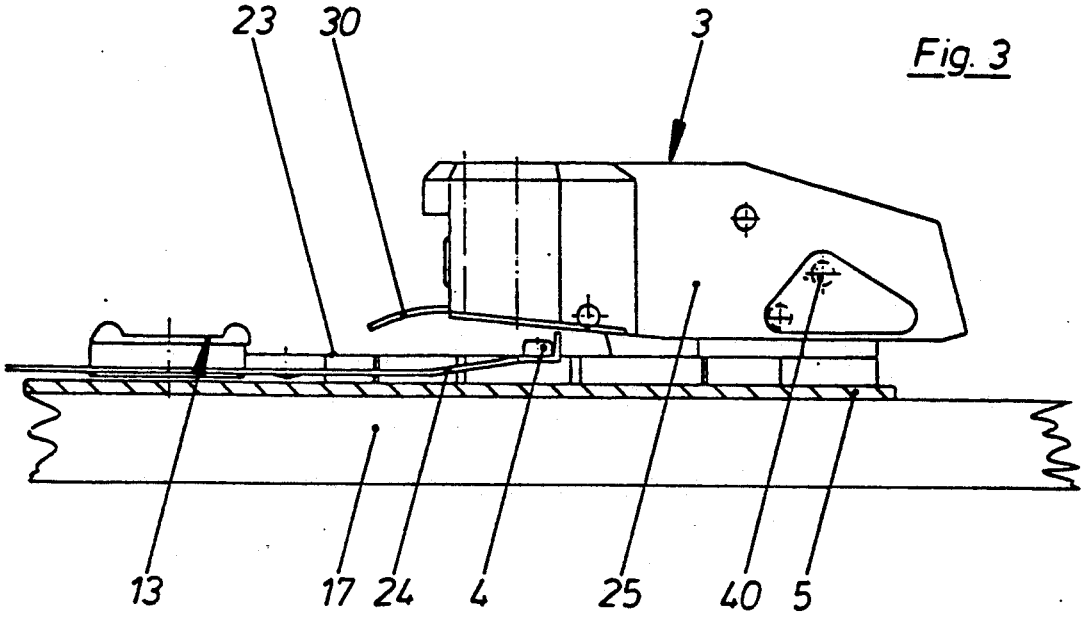
Figure 3A:
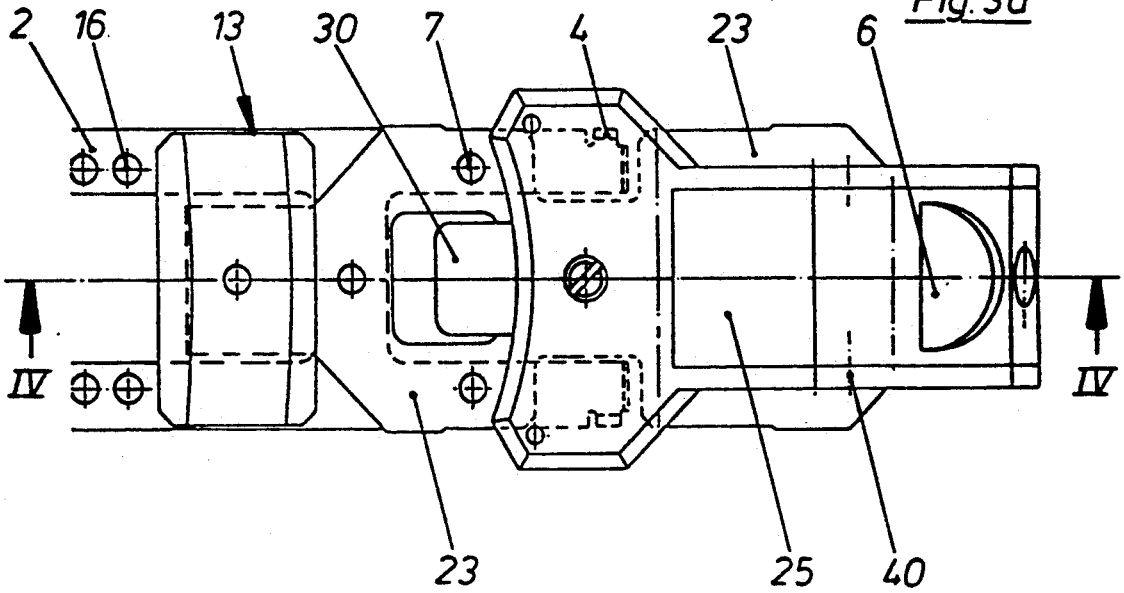
Figure 4A:
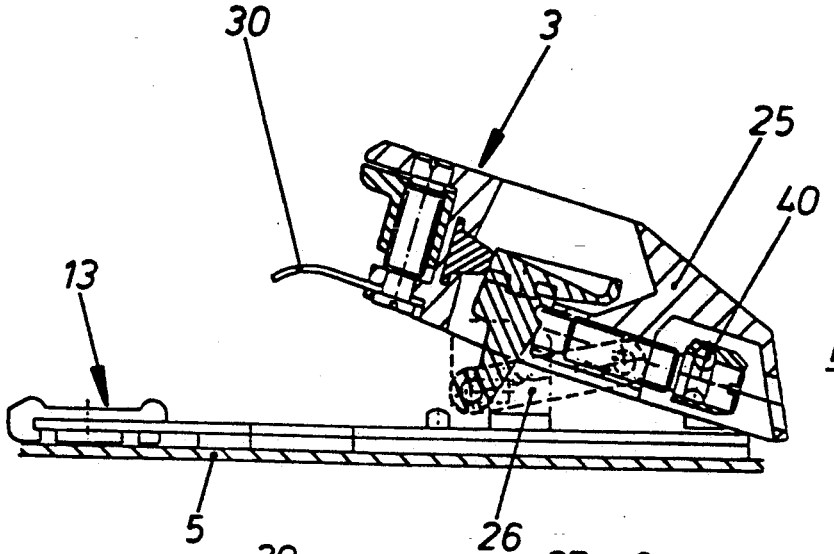
Figure 4:
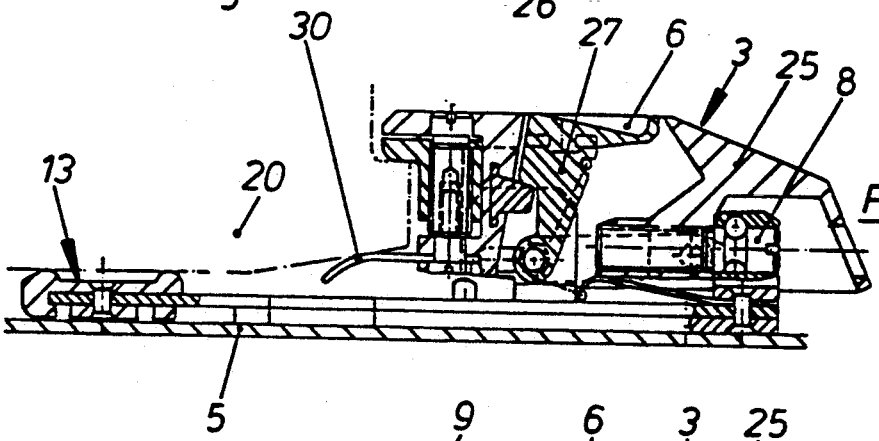
Figure 4B:
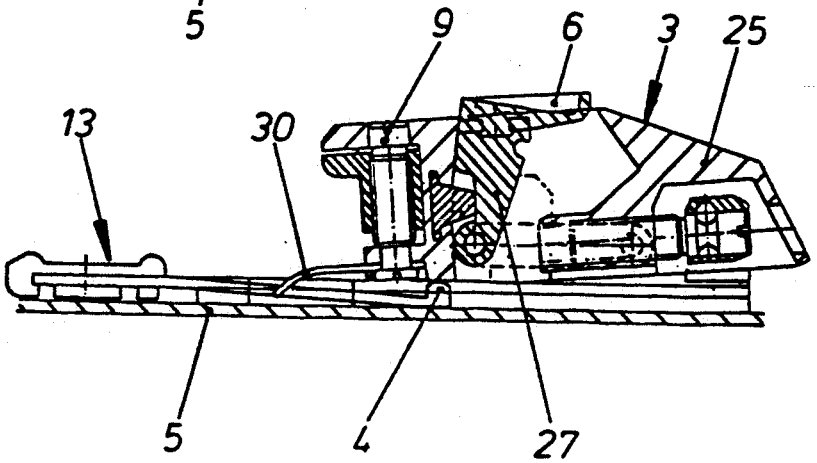
Figure 5:
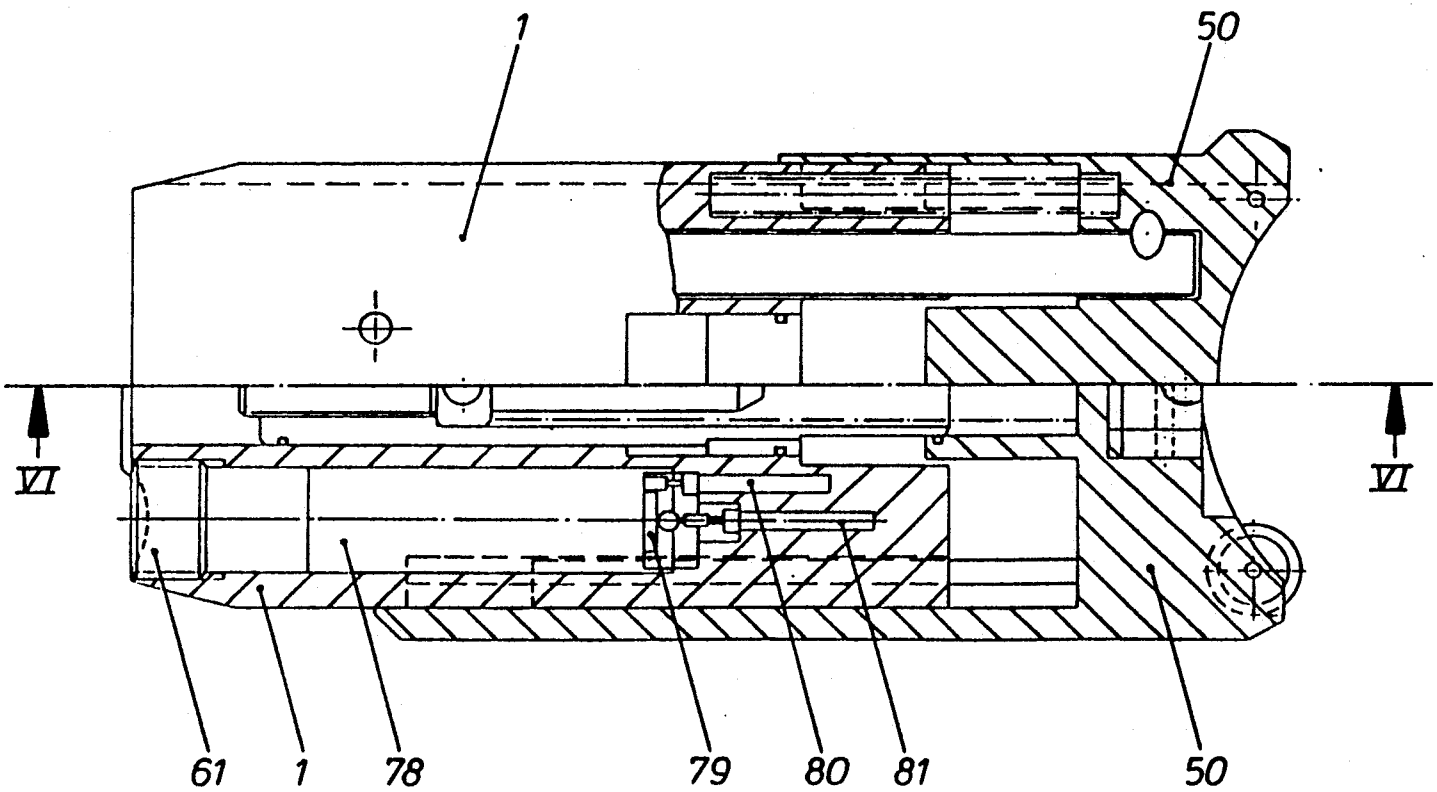
Figure 6:
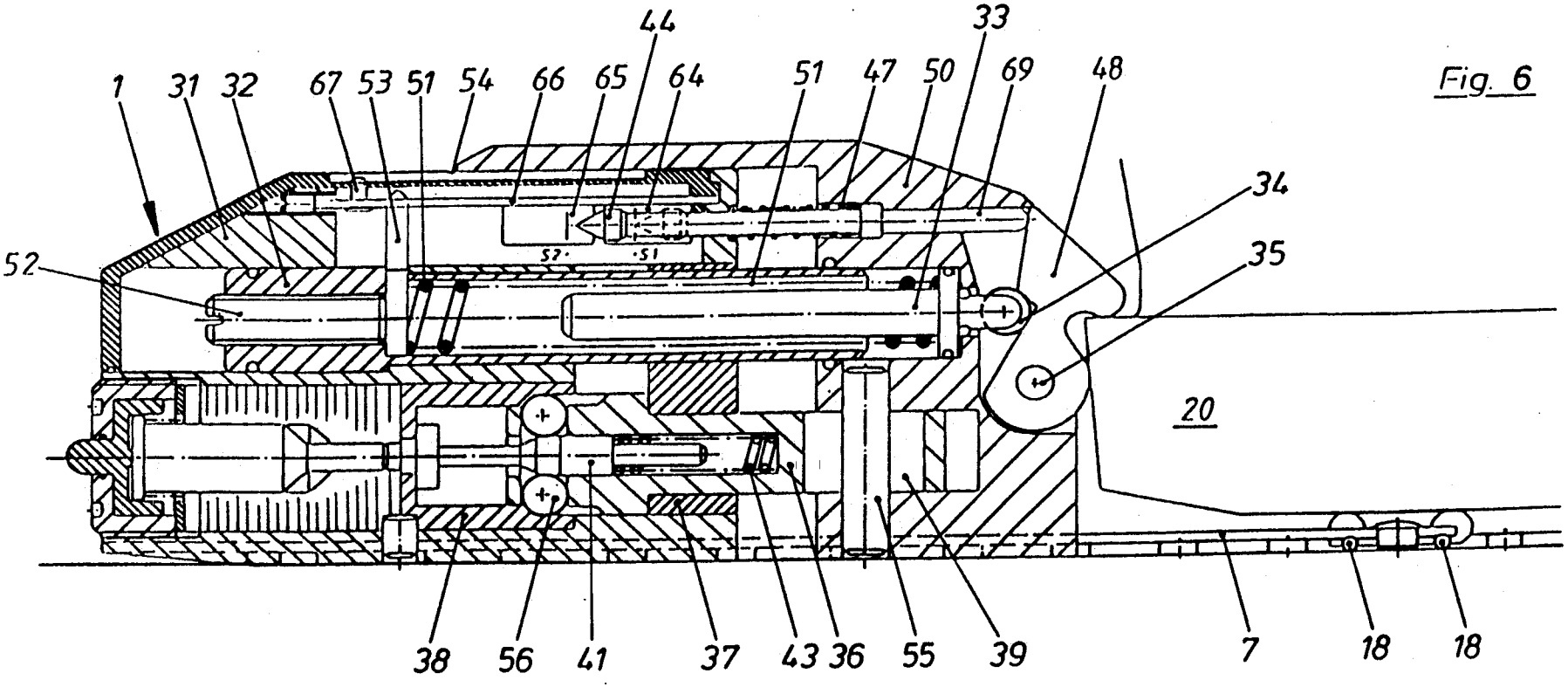
Figure 6A:
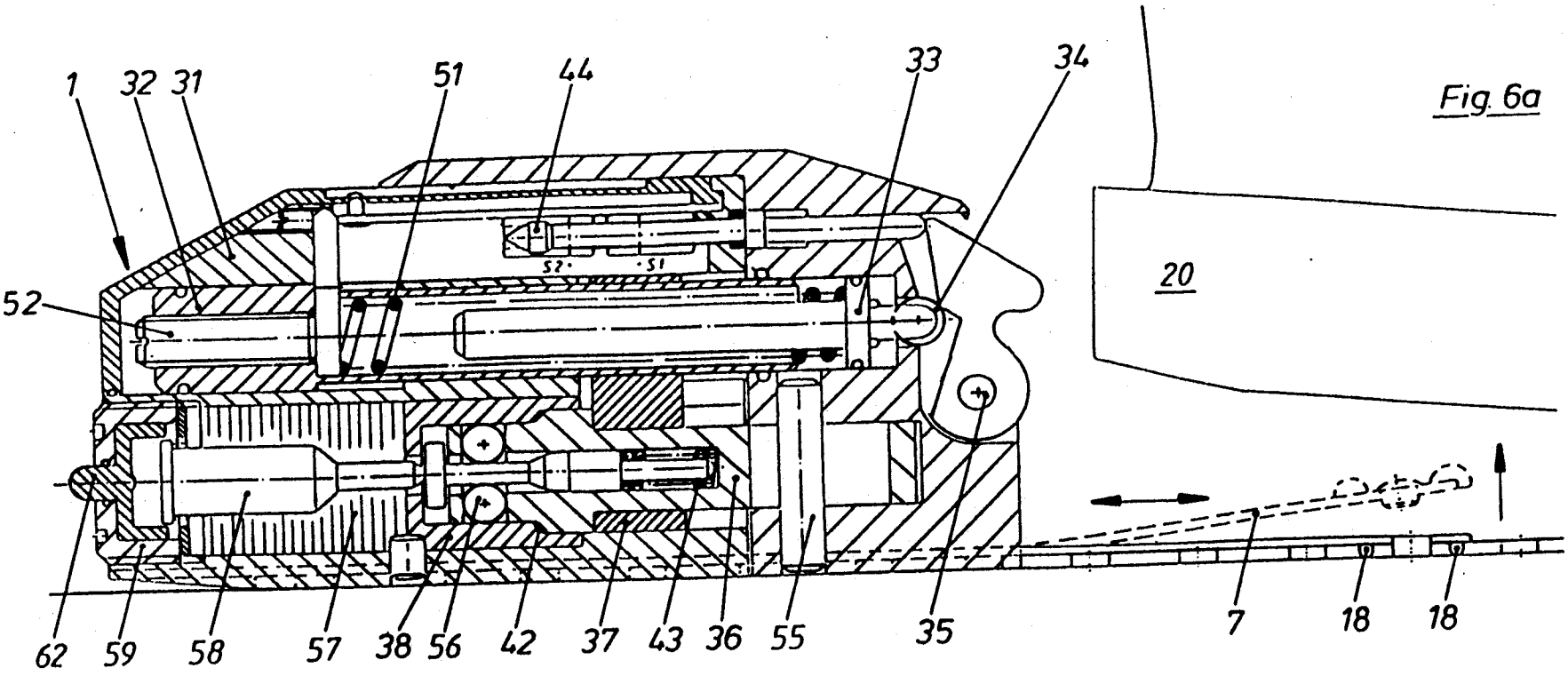
Figure 7:
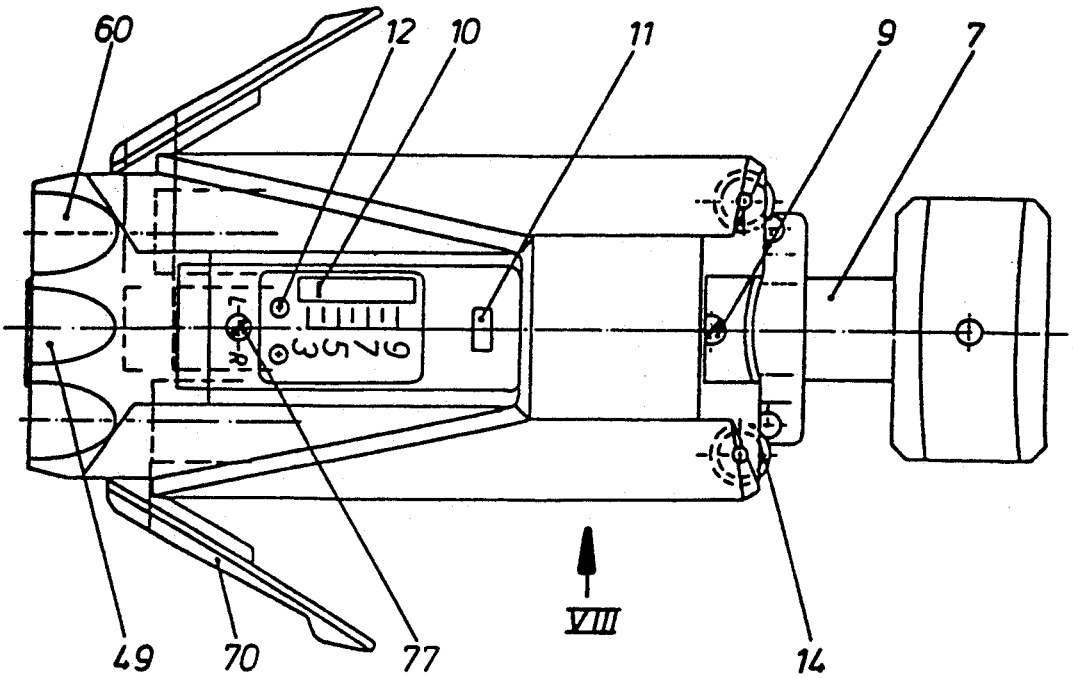
Figure 8:
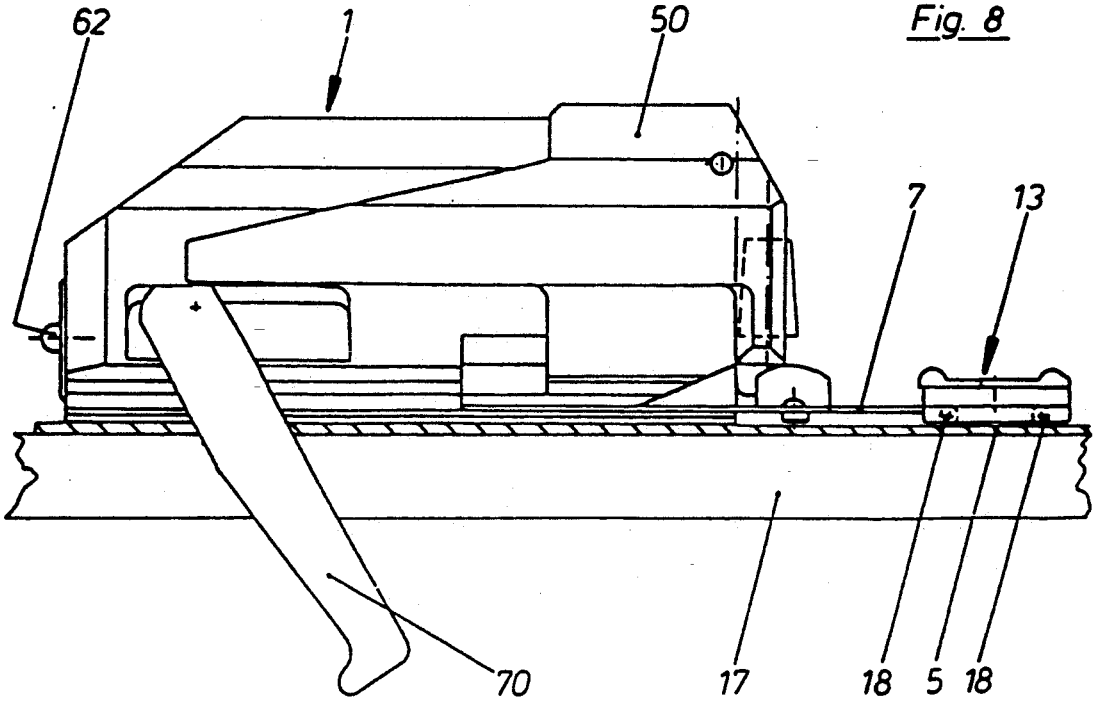
Figure 10:
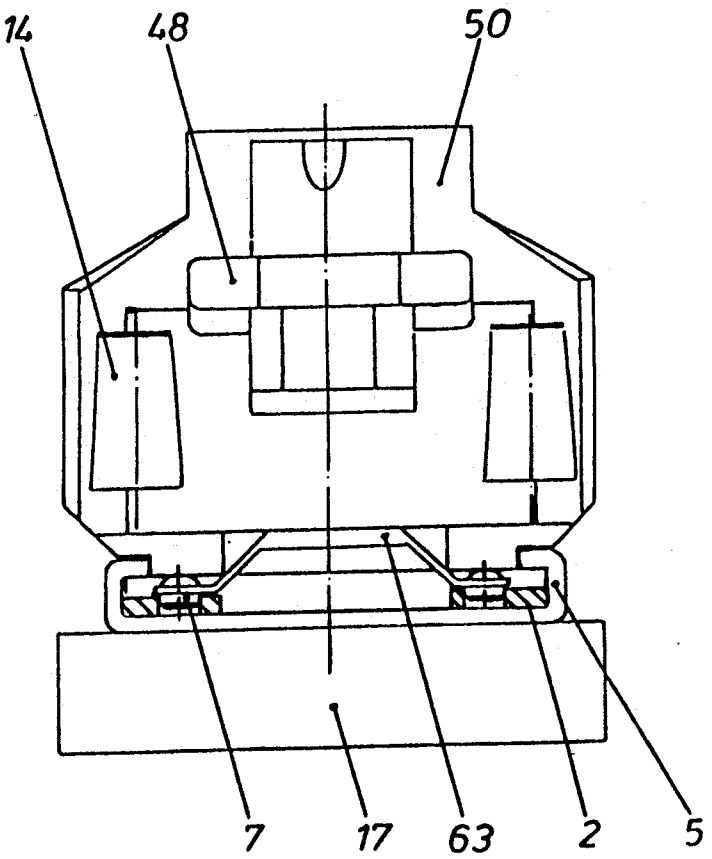
Figure 9:
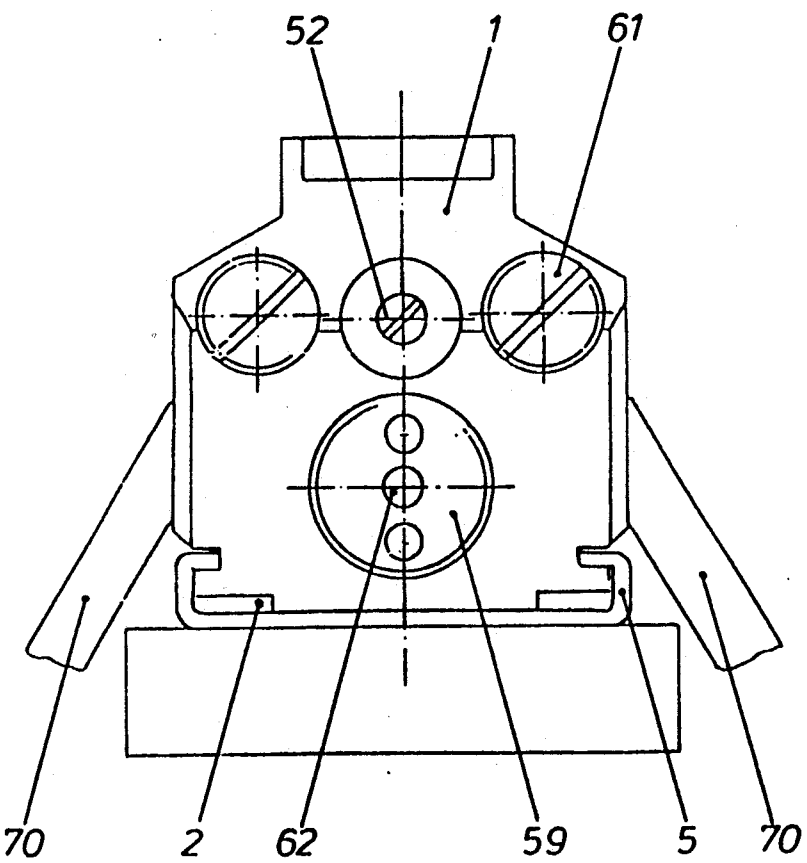
Figure 11:
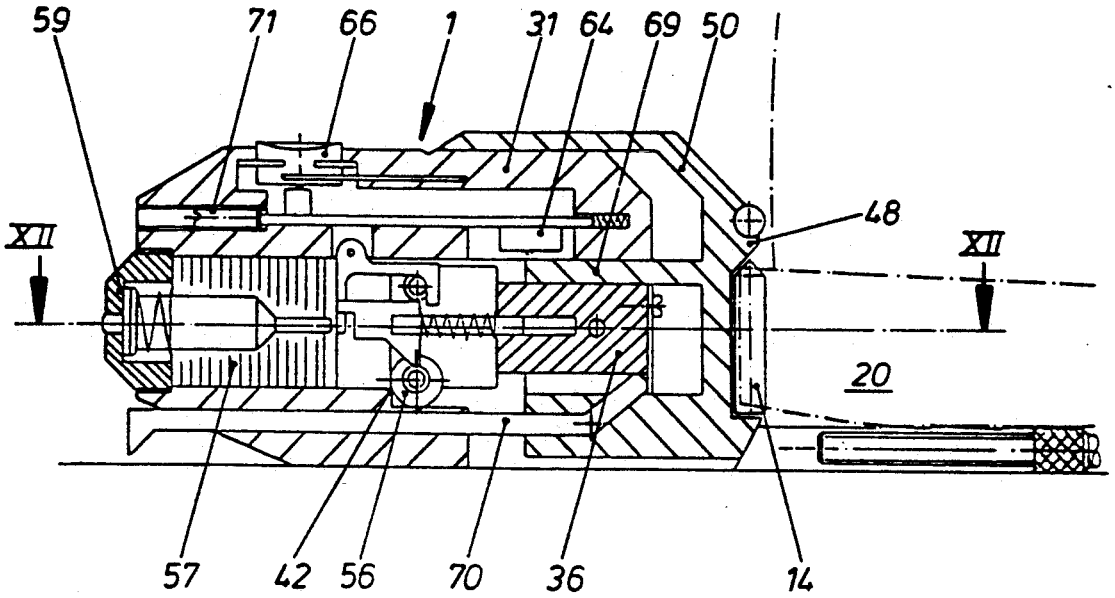
Figure 12:
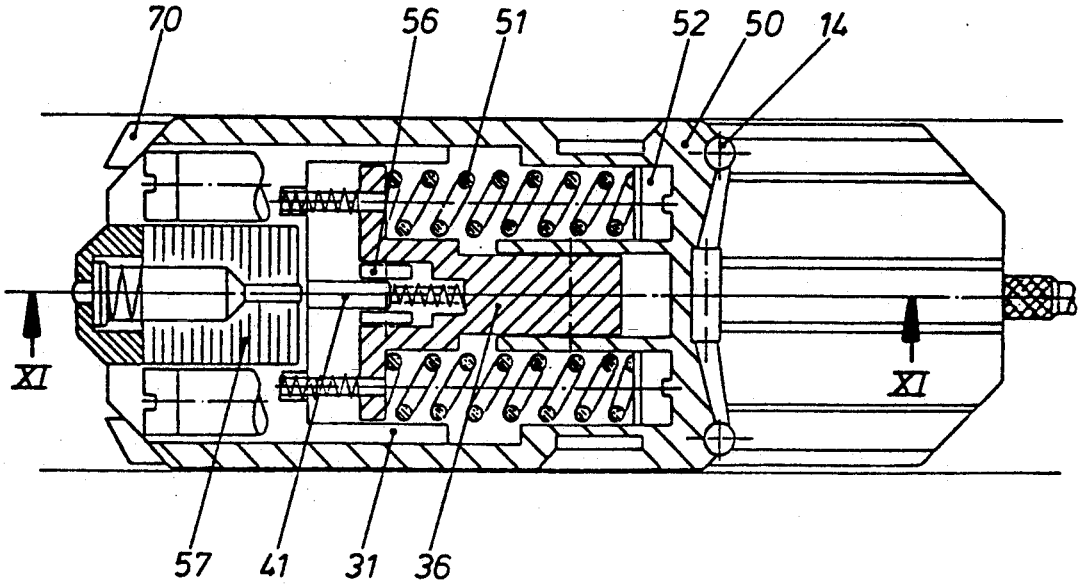

FIG. 2*a* is the corresponding top plan view,

FIG. 2*b* is the top plan view of the same ski binding which, however, is partly disassembled, FIG. 3 is an enlarged side elevation of the front part of the ski binding, FIG. 3*a* is the top plan view belonging to FIG. 3, FIG. 4 is the vertical section IV—IV in FIG. 3*a* with the binding ready to go, FIG. 4*a* is a section corresponding to FIG. 4, showing the binding ready for step-in, FIG. 4*b* is a section corresponding to FIG. 4, showing a disassembly position, FIG. 5 shows the heel part of the ski binding in top plan view, partly cut in horizontal planes, FIG. 6 is the vertical section VI—VI in FIG. 5 with the binding ready to go, FIG. 6*a* is a corresponding section upon release of the heel part, FIG. 7 is the complete top plan view of the heel part, FIG. 8 shows the heel part in side elevation according to arrow VIII of FIG. 7, FIG. 9 shows the heel part, as seen from the rear, FIG. 10 shows the heel part, as seen from the front, FIG. 11 shows a modified heel part in vertical cross section XI—XI of FIG. 12, and FIG. 12 is the vertical section XII—XII in FIG. 11.

Figure 1:
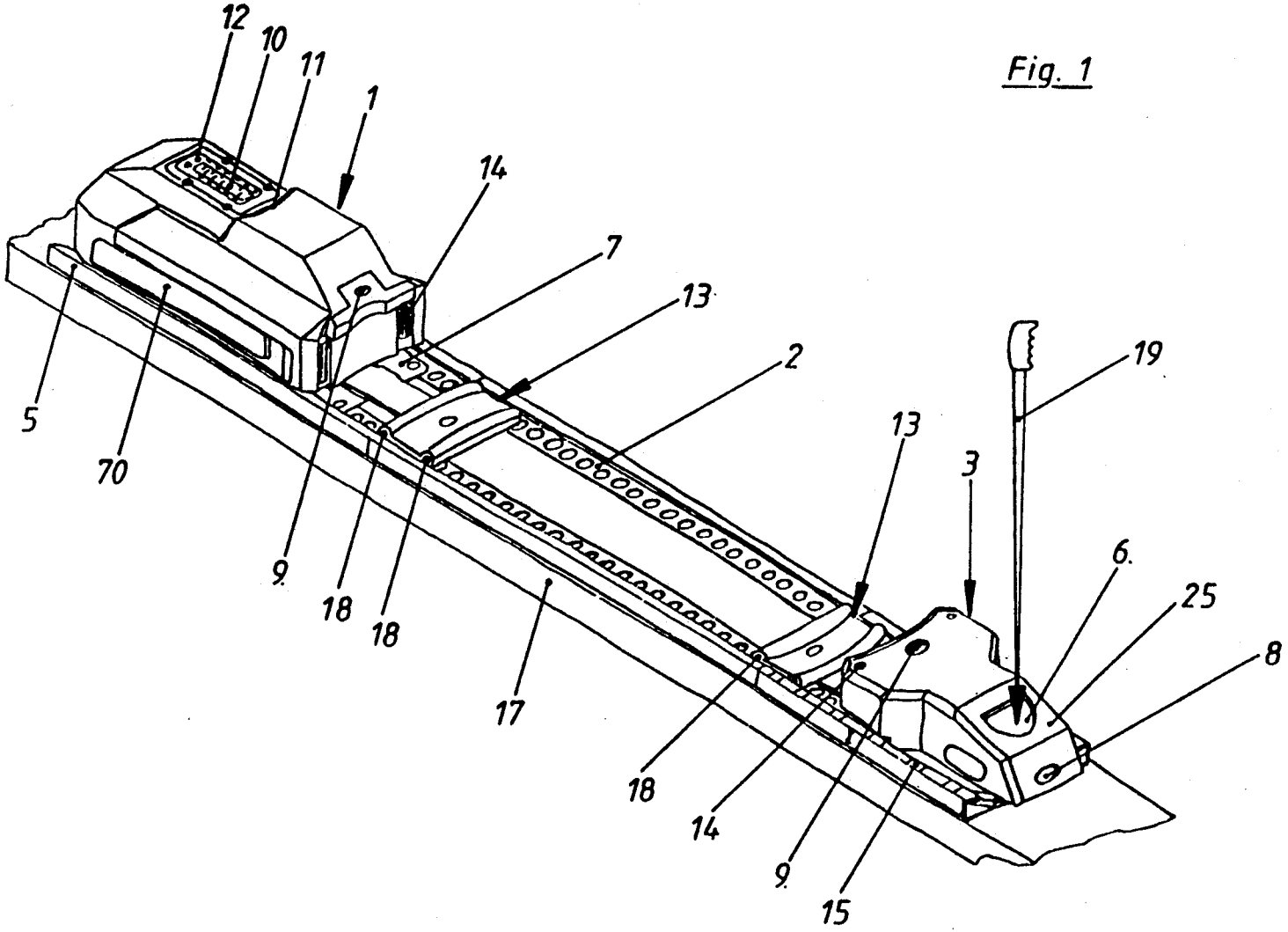
FIG. 1 is an oblique view of a complete ski binding.

FIG. 1 is an oblique view from the front and from top of the entire ski binding. The principal components thereof are a heel part 1, a pair of connecting strips 2, and a front part 3. Together they constitute a unit which is exchangeable as a whole and is held in a selectable position by detent means 4 fastening it to take-up rails 5 which are firmly mounted on the ski 17 by screws 22. The heel and front parts 1 and 3 of the ski binding are arrested by fastening means 7 in correspondence with the size of the corresponding ski boot 20 (FIG. 2 et seq.) on the connecting strips 2.

The front part 3 can be opened by introducing the tip of a ski pole 19 in a pan 6. Fine adjustment to correspond to different ski boot sizes is accomplished by a longitudinal set screw 8 arranged so as to be readily accessible in the front portion of front part 3. A vertical set screw 9 permits the required height to be adjusted in accordance with ski boot soles of varying thicknesses.

A pair of vertical deflector rolls 14 each is supported at the heel and front parts 1 and 3. In per se known manner they permit horizontal release of the ski boot 20 whose front and rear sole edges they support. Other than that, the sole of the ski boot 20 (FIGS. 2, 4, et seq.) merely rests on mounts 13. As there is room between the connecting strips 2 to receive snow or dirt which may adhere to the sole of the boot, the release characteristics are not changed by any pressing or additional friction. The mounts 13 include rollers 18 at their bottoms for rolling movement between the connecting strips 2.

At the upper side of the heel part 1 there is an indicator including a scale 10 for the skier's own weight and a scale 11 for the contact pressure at a given length of the ski boot 20 as well as a display 12 for electrical functions by which the skier can verify the proper functioning of his ski binding at any time. All of this permits better adaptation of the ski binding to the respective skills of the skier or to external circumstances.

FIGS. 2 and 2*a* are a side elevation and top plan view, respectively, showing the heel part 1, the front part 3, and the releasable detent means 4 at the front part 3. FIG. 2*b* is the corresponding top plan view without the heel part 1 and with the front part 3 broken away in part. As shown in FIGS. 2*a* and 2*b*, the connecting strips 2 are formed with locking apertures 16 and interconnected at their ends by webs so that they can be slipped as a unit into the take-up rails 5. The fastening means 7 of the heel part 1 and of the front part 3 can be latched in the locking apertures 16.

The front part 3 has a socket which is firmly mounted on a base plate 23 by rivets 21. The fastening means 7 of the front part 3 are disposed on the base plate 23. The connecting strips 2 have a common front end 24 of the type of a leaf spring which is bent upwardly, as seen in FIG. 3, and carries the detent means 4. The take-up rail 5 in the region of the front part 3 includes rack-like notch arrangements 15 to be engaged by the detent means 4 below the front part 3.

As shown in FIG. 2*b*, the fastening means 7 of the heel part 1 and of the front part 3 are firmly caught in the locking apertures 16 of the connecting strips 2. Hereby the ski binding is set for a certain sole length of the ski boot 20. The entire ski binding is secured by the detent means 4 being caught in the notch arrangements 15 of the take-up rail 5 in the selected position on the ski 17, such as for downhill or for slalom skiing.

As shown in FIGS. 3*a* and 4*a*, the front part 3 includes a housing 25 which is tiltable about a pivot axis 40 with respect to the base plate 23, the pivot axis extending at right angles to the longitudinal direction of the take-up rail 5 parallel to the plane of the ski. FIGS. 4, 4*a*, and 4*b* illustrate a known manner in which to secure the housing 25 of the front part 3 to the base plate 23 thereof by means of a toggle lever 26 which is pivotable from the step-in position shown in FIG. 4*a* into a stretched out position shown in FIG. 4 by a person stepping with the front portion of the sole of the ski boot 20 on a pedal 30.

The toggle lever 26 is releasable by a lever 27 which is formed with the pan 6. The front part 3 is unlocked when the lever 27 is actuated mechanically, for instance by applying a downwardly directed force on the pan 6 by way of the ski pole 19. That will cause the housing 25 to swing upwardly, in FIG. 4*a*, about the pivot axis 40 by an angle of aperture which preferably is greater than 25°. This opening angle, however, is much smaller than the angle required for opening and closing of a ski binding which includes an upwardly movable heel part.

If one presses on the housing 25, as shown in FIG. 4*b*, near the vertical setscrew 9, the housing 25 will tilt down about the pivot axis 40 from the ready-to-go position illustrated in FIG. 4, thereby pressing the detent means 4 out of the notch arrangements 15 of the take-up rail 5. The whole binding now may be adjusted along the take-up rail 5 or be pulled out altogether. If the housing 25 subsequently is let go again, the detent means 4 can enter into engagement, as shown in FIG. 4, in the notch arrangements 15 with the binding unit in its new position.

As shown in FIGS. 5 to 10 et seq. the heel part 1 includes a backing member 50 which clamps the rear heel edge of the ski boot 20 by means of a spring-loaded sole holder 48. The backing member 50 is guided for longitudinal displacement on a housing 31 of the heel part 1. A sleeve 32 which is open at the front and contains a spring 51 is likewise guided for longitudinal displacement in the housing 31. At the rear the spring 51 is supported on a setscrew 52 which is threaded from behind into the sleeve 32. The front end of the spring 51 presses against a tappet 33 at the front end of which a roll 34 is supported. The roll 34 presses from behind against the sole holder 48 which is supported at the backing member 50 for pivoting about a transverse axis 35.

The spring 51 thus urges the backing member 50 forwardly in the direction of the ski boot 20. The bias of the spring 51 can be varied from outside by way of the setscrew 52 to correspond to the skier's body weight. Display means 53,54 inform the skier of changes made in the adjustment.

A locking element 36 is guided for longitudinal displacement in the lower part of the housing 31. The locking member is firmly connected by a bridge 37 to the sleeve 32 and has its rear end protruding more or less far into a blocking sleeve 38 fixed in the housing 31. Movability of the backing member 50 to the front is limited by a vertical pin 55 which passes through a longitudinal slot 39 in the locking element 36. The locking element 36 and the blocking sleeve 38 form part of a locking device which includes a pair of roller bodies 56 received in the cage-like rear end of the locking element 36. When the binding is ready for skiing, as shown in FIG. 6, they are spread apart by a wedge-shaped key 41 so that they abut against a step 42 of the blocking sleeve 38, thereby preventing further penetration of the locking element 36 into the blocking sleeve 38.

The locking device can be disengaged by way of an electromagnet 57 and a magnetic armature 58. That is achieved by the magnetic armature 58 hitting the rear end of the key 41 like a bullet upon excitation of the electromagnet 57, whereby the key is pushed forward against the resistance of a return spring 43 so that the roller bodies 56 approach each other and can no longer prevent the locking element 36 from following the pressure of the spring 51 and entering more deeply into the blocking sleeve 38, as shown in FIG. 6. As a consequence, the backing member 50 can yield in backward direction to the pressure exerted by the ski boot 20 so that the sole holder 48 sets free the heel of the ski boot.

The housing 42 is closed behind the electromagnet 57 by a closure cap 59 which is threaded in.

As shown in FIGS. 6 and 6*a*, a mechanical signal transmitter 69 is guided for displacement to the rear against the resistance of a spring 47 in the backing member 50. At its rear end the signal transmitter 69 has a thickened portion 44 with a tip pointing to the rear. A front signal receiver 64 and a rear signal receiver 65 are disposed within the range of movement of this thickened portion 44; they are actuated when the thickened portion 44 reaches a switching position S1 or S2. That happens as a consequence of the loading of the sole holder 48 occurring during skiing, whereby the backing member 50 and the signal transmitter are urged backwardly.

The front signal transmitter 64, when actuated, activates batteries 78 (FIG. 5) which are housed in the heel part 1. If the pressure acting on the backing member 50 and thus also on the signal transmitter continues to rise and if the latter consequently is displaced further to the rear, then next the rear signal transmitter 65 will be actuated. It is connected in a circuit which includes a timer. This timer takes care that no power is supplied to the electromagnet 57 until the duration of the action of the signal transmitter 69 on the signal receivers 64 and 65 has surpassed a certain time period. In this manner release of the heel part 1 is prevented upon brief backward displacements of the backing member 50, such as because the skier takes a jump.

When the time period is surpassed, the electromagnet 57 is activated and thereby the magnetic armature 58 is attracted. It will hit the key 41 like a bullet, in principle in a manner known per se, thereby releasing the roller bodies 56. Thereby the backing member 50 is set free and may now become displaced backwardly by a rather great distance so that the ski boot 20 is totally free to fall out of the ski binding. The skier, therefore, may fall in whatever direction without the binding presenting any risk.

When the ski boot 20 is no longer held by the binding, there is no longer any pressure acting in backward direction on the mechanical signal transmitter 69 which thus is moved in forward direction by its spring 47. That immediately interrupts the current so that the batteries are saved. The batteries used preferably are lithium $SO_2$ batteries provided, as shown in FIG. 5, with one-sided current contacting 79 for connection to contacts 80 and 81 disposed inside the housing 31. Such batteries can be guaranteed to function for a year at minus 50°. An additional signal transmitter 67 is disposed at the upper side of the heel part 1 to permit checking of the functioning of the release system.

Even if the electronic circuit should fail, the ski boot 20 still can be deflected laterally both in front and rear by the deflector rolls 14, if the skier should fall. Without the electromagnetically released retreat of the backing member 50 the ski boot 20 then is totally set free if it exerts a rearwardly directed force of such magnitude on the backing member 50 by way of the sole holder 48 that the backing member 50, acting against increasing resistance by the springs 47 and 51, reaches a position at boot 20. Subsequently the springs 43, 47, and 51 return the heel part 1 into its starting position.

Brackets of a ski brake 70 are supported in lateral recesses of the heel part 1. With the ski binding in closed condition, as shown in FIG. 1, they are integrated in form lock in the heel part 1. FIGS. 7 and 8 are a top plan view and side elevation, respectively, of the heel part 1 upon liberation of the ski boot 20 with the ski brake 70 extended.

Openings 49 and 60 are to be seen at the rear end of the heel part 1; setscrew 52 is accessible through opening 49, and batteries 78 can be introduced through the openings 60. Likewise at the rear end, in the closure cap 59, there is an emergency release button 62 to be actuated manually so as to jerk the magnetic armature 58 forwardly into its release position according to FIG. 6*a*. This gives the skier the opportunity at any time to check the proper functioning of the binding.

FIG. 7 again clearly shows the indications 10,11, and 12 as well as the vertical setscrew 9 and the location of the vertical deflector rolls 14. It may be taken from FIG. 8 how the jaw-like backing member 50 is coordinated with the corresponding mount 13. Likewise to be seen is the firm arrangement of the take-up rail 5 on the ski 17 and the arrangement of the rollers 18 underneath the mount 13.

FIG. 9 is a view belonging to FIGS. 5 to 8 of the heel part 1 with the ski brake 70 extended, as seen from the rear and showing the location of the connecting strips 2 in the take-up rail 5. Likewise shown are the setscrew 52 and battery closure screws 61, the closure cap 59, and the emergency release button 62.

FIG. 10 is the front view belonging to FIGS. 5 to 9 of the heel part 1 with the deflector rolls 14, the sole holder 48, and the backing member 50. The rear fastening means 7 each are attached by a leaf spring 63 to the housing 31 of the heel part 1 and each engage in one of the locking apertures 16 of the connecting strips 2 which are guided in the take-up rail 5 so that the housing 31 is retained in the selected position of adjustment.

FIGS. 11 and 12 represent another embodiment of a heel part 1. Here the sole holder 48 is formed directly at the backing member 50. An additional electrical emergency release button 66 is arranged in the housing 31, as well as a setscrew 71 for accurate adjustment of the signal receivers 64 and 65 (FIG. 6). Upon unscrewing of the closure cap 59 the electromagnet 57 and the magnetic armature 58 are pushed from behind into the heel part 1.

Other than as presented in FIGS. 5 to 10, the backing member 50 according to FIGS. 11 and 12 is supported on the housing 31 of the heel part 1 by a pair of springs 51. The springs 51 are adjustable to the skier's body weight by a setscrew 52 each.

In all the embodiments the electronic release can be adjusted to predetermined release values (e.g. for beginners or racing professionals) by a rotary contact 77 shown in FIG. 7.

Unauthorized use of the ski binding can be prevented by a locking device which is positioned between the backing member 50 and the emergency release button 62 and which unlocks the roller closure by its being positioned, thereby preventing any abuse of the ski binding. This kind of theft precaution may be given a certain proprietor's code so as to exclude use by any third party. Moreover, the electronic release may be remote controlled which means that when stepping out of the ski binding lastly only a remote control member carried on the body need be operated.

What is claimed is:

1. In an automatically releasable ski binding unit, comprising front and heel parts, a mechanical boot retaining system, an electronic control system powered by a battery power source, and a release system for the ski boot, the improvement wherein:

the front part is tiltable about an axis which extends transversely of the longitudinal axis of the ski, and the heel part includes a housing, a backing member mounted to said housing for movement along said longitudinal axis, a sole holder which is movable longitudinally with respect to the housing and disposed to be engaged by said backing member and urged forward responsively to forward movement of said backing member to engagingly lock said ski boot to said heel unit, first spring means disposed within said housing and mounted for movement along said longitudinal axis and disposed when compressed to urge said backing member forward along said housing against said sole holder, locking means for releasably holding said first spring means affixed to said housing in said compressed state and including key means for operating said locking means to a released state to release said heel part from said ski boot, electromagnet means associated with said control system for actuating said key means to release said first spring means upon energization of said electromagnet, signal receiver means disposed within said housing for connecting said control system to said power source, signal transmitter means operably responsive to movement of said sole holder beyond a given rearward limit for actuating said signal receiver means to connect said control system to said current supply, timing means for energizing said electromagnet means a given time after actuation of said signal receiver means, and wherein said signal transmitter means is guided in said backing member for backward movement and includes second spring means for providing resistance to said backward movement, said signal transmitter means having a front portion disposed to engage said sole holder.

2. The ski binding unit as claimed in claim 1, characterized in that the signal receiver means comprises a front sensor which activates said power source when actuated by the signal transmitter means and a rear sensor which actuates the electromagnet means through said timing means when actuated by the signal transmitter means, said rear sensor actuating said electromagnet means through said timing means responsively to a rearward motion of said signal transmitter means a given distance beyond that corresponding to a locked static ski boot, said front sensor activating said power source responsively to movement of said signal transmitter means a given distance forward beyond that corresponding to a locked static ski boot.

3. In an automatically releasable ski binding unit, comprising front and heel parts, a mechanical boot retaining system, an electronic control system powered by a battery power source, and a release system for the ski boot, the improvement comprising:

a pair of parallel connecting strips to which said front and heel parts are mountable, said front part being mounted for tilting rotation about an axis which extends transversely of the longitudinal axis of said strips;

an elongated take-up rail mountable to a ski to have its major dimension extending along the longitudinal axis of said ski, said strips being configured to be guided in said take-up rail; and detent means for locking said strips to said rail in the area of the front part only.

4. The ski binding unit as claimed in claim 3, characterized in that said detent means are adapted to be unlocked by the front part being tiltable in a downward direction about said transverse axis from its position of use.

5. The ski binding unit as claimed in claim 4, wherein a mount each is associated with the heel and front parts, these mounts being configured to be guided on the take-up rail between the connecting strips and to present platforms for a ski boot.

6. A ski boot binding system comprising:

toe and heel binding units;

toe unit mounting means for permitting rotation of at least a sole-engaging portion of said toe binding unit about an axis transverse to the longitudinal direction of said ski;

mounting platform means for mountably accepting said binding units;

guide means attachable to a ski and configured for slidingly captively accepting said mounting platform means for movement along said longitudinal direction of said ski; and releasable first locking means associated with said toe binding unit for locking said mounting platform means to said guide means at a plurality of chosen positions, said first locking means including detent means responsive to rotation of said sole-engaging portion in a first direction about said axis downward from a sole locking position for operation said first locking means to a releasing condition.

7. The ski binding unit of claim 6 wherein said sole-engaging portion is rotatable from said sole locking position in a second direction opposite to said first direction to a sole releasing position, and including releasable second locking means for preventing said rotation in said second direction from said sole locking position.

8. The ski binding unit of claim 6 including toe platform means for supporting the lower surface of said sole with said sole locked into said toe binding unit and positioned so as to prevent depression of said sole from operating said first locking means to said releasing condition.

9. The ski binding unit of claim 7 including toe platform means for supporting the lower surface of said sole with said sole locked into said toe binding unit and positioned so as to prevent depression of said sole from operating said first locking means to said releasing condition.

10. In a ski boot binding system having toe and heel binding units attachable to a ski, said toe binding unit having sole-engaging means for providing locking engagement with the toe portion of the sole of an inserted boot, said heel binding unit including sole-engaging means for providing locking engagement with the heel portion of said sole, resilient biasing means for urging said heel unit sole-engaging means towards the heel of said inserted ski boot, ad electrically powered release means adapted for connection to a battery for operating said heel unit sole-engaging means to a releasing condition to release said boot responsively to heel pressures against said heel unit sole-engaging means above a given threshold value, the improvement comprising:

pivoting mounting means for mounting said toe unit sole-engaging-means for rotation about an axis transverse to the longitudinal direction of said ski to be tiltable forward and away from the upper surface of said ski to provide space for accepting the insertion of said ski boot to engage said heel unit sole-engaging means and to force said heel of said ski boot against said heel unit sole-engaging means responsively to rotation of said toe unit sole-engaging means into a non-tilted orientation to close said toe binding unit;

switching means operatively responsive to the movement of said heel unit sole-engaging means for providing electrical power to said release means, said switch means being configured to be in an open non-power-supplying condition at the static closure pressure against said heel unit sole-engaging means caused by complete closure of said toe binding unit and be operable to a closed condition above said threshold pressure value; and releasable toe unit locking means for locking said toe unit sole-engaging means in said non-tilted orientation.

11. The binding system of claim 10 wherein said release means includes electrically powered timing means operable to an energy-consuming state responsively to closure of said switching means for delaying operation of said release means to a releasing condition until after said threshold pressure value has been exceeded for a given continuous period of time.

12. The binding system of claim 10 wherein said release means includes electrically powered solenoid means operable by the energization of said solenoid means to actuate said release means to a releasing condition.

13. The binding system of claim 12 wherein said release means includes resiliently biased latching member operable to a locking position for locking said release means, and said solenoid means includes movable core means oriented to move a given distance and thereafter strike said latching member to operate said release means to said releasing condition upon energization of said solenoid means, and means for urging said core means away from said latching member when said solenoid means is in a de-energized condition.

14. The binding system of claim 11 wherein said release means includes electrically powered solenoid means operable by the energization of said solenoid means to actuate said release means to a releasing condition.

15. The binding system of claim 14 wherein said release means includes a resiliently biased latching member operable to a locking position for locking said release means, and said solenoid means includes movable core means oriented to move a given distance and thereafter strike said latching member to operate said release means to said releasing condition upon energization of said solenoid means, and means for urging said core means away from said latching member when said solenoid means is in a de-energized condition.

* * * * *